US006343384B1

(12) United States Patent
Ida

(10) Patent No.: US 6,343,384 B1
(45) Date of Patent: Feb. 5, 2002

(54) WAIST ADJUSTING DEVICE

(75) Inventor: Kazuo Ida, Toyama-ken (JP)

(73) Assignee: YKK Corporation, Tokyo (JP)

( * ) Notice: Subject to any disclaimer, the term of this patent is extended or adjusted under 35 U.S.C. 154(b) by 0 days.

(21) Appl. No.: 09/615,046

(22) Filed: Jul. 12, 2000

(30) Foreign Application Priority Data

Jul. 16, 1999 (JP) ..... 11-202590
Aug. 31, 1999 (JP) ..... 11-246260
Dec. 27, 1999 (JP) ..... 11-371214

(51) Int. Cl.[7] ..... A41F 1/00; A41F 9/00
(52) U.S. Cl. ..... 2/236; 2/338
(58) Field of Search ..... 2/236, 237, 311, 2/321, 322, 338; 24/170, 191

(56) References Cited

U.S. PATENT DOCUMENTS 1,113,435 A * 10/1914 Hartmann
1,682,450 A * 8/1928 Wanninger et al.
2,575,952 A * 11/1951 Goff ..... 2/321
2,900,696 A * 8/1959 Bacon ..... 24/206
3,438,063 A * 4/1969 Loston ..... 2/322
3,466,668 A * 9/1969 Ochiai ..... 2/322
3,835,473 A * 9/1974 Toyoda ..... 2/237
3,913,147 A * 10/1975 Ostrander ..... 2/325
3,969,795 A * 7/1976 Stephenson ..... 24/203
4,025,991 A * 5/1977 Miner ..... 24/191
4,133,082 A 1/1979 Kanzaka
4,369,529 A * 1/1983 Yahata ..... 2/322
4,425,735 A * 1/1984 Kulesza et al. ..... 46/202
4,930,324 A * 6/1990 Meier ..... 70/18
5,491,845 A * 2/1996 Takimoto ..... 2/338
5,519,893 A * 5/1996 Silver ..... 2/321
5,572,747 A * 11/1996 Cheng ..... 2/322
5,687,455 A * 11/1997 Alexander ..... 24/16
5,732,448 A * 3/1998 Shields et al. ..... 24/180
6,067,662 A * 5/2000 Sim ..... 2/339
6,205,630 B1 * 3/2001 Mori ..... 24/633

FOREIGN PATENT DOCUMENTS

| | | |
|---|---|---|
| JP | 10179215 | 7/1988 |
| JP | 09273013 | 10/1997 |
| WO | WO 97/32495 | 9/1997 |

OTHER PUBLICATIONS

European Search Report dated Aug. 10, 2001, issued in corresponding Application No. EPO 00114161.

* cited by examiner

*Primary Examiner*—John J. Calvert
*Assistant Examiner*—Alissa L. Hoey
(74) *Attorney, Agent, or Firm*—Finnegan, Henderson, Farabow, Garrett & Dunner, L.L.P.

(57) ABSTRACT

An object of the invention is to provide a waist adjusting device, in which the number of components is reduced, an assembly thereof is not necessary because of its simple structure so as to achieve reduction of production cost and the adjustment operation is very simple. An adjusting belt has a multiplicity of adjusting protrusions on the surface thereof and a slider has a through portion which the adjusting belt can be passed through in the right and left direction. Engaging protrusions which are capable of engaging the adjusting protrusions, when the adjusting belt is passed through an upper section of the through portion, are provided on both sides of an inner face of a through hole provided on a rear plate thereof. Attaching holes whose inner side is expanded are provided in a surface plate and a fixing device has two attaching posts, which are inserted into the attaching holes and fixed by crushing, at a rear face of a cap. Attaching posts are pierced into a waist belt and crushed in the attaching holes so as to fix the slider. After the slider is attached on the adjusting belt, the adjusting belt is attached to the waist belt. By moving the slider downward together with the waist belt, engagement therebetween is released. After adjustment is completed, the slider and waist belt are returned to their original positions.

12 Claims, 20 Drawing Sheets

WAIST ADJUSTING DEVICE

BACKGROUND OF THE INVENTION

1. Field of the Invention

The present invention relates to a waist adjusting device generally called waist adjuster or belt adjuster, which is capable of adjusting the length of a waist belt in clothes, for example, beltless trousers or skirts.

2. Description of the Related Art

A conventional waist adjusting device will be described next. A slider is attached by means of a fixing device to a rear face of a waist belt located outside at an overlapping portion of for example, beltless trousers or skirt as shown in FIG. 17. Then, an adjusting belt having adjusting protrusions arranged at a predetermined interval or if the adjusting belt is attached on the rear face of a common foundation, both the adjusting belt and the common foundation are inserted through the slider. Both ends of each of the adjusting belt and common foundation are sewed to the waist belt located inside and then, an operating piece having engaging protrusions capable of engaging the adjusting protrusions is inserted into the slider from above. Consequently, the adjustment of the length of the waist is carried out.

The structure is shown in FIG. 32 for example, and disclosed in Japanese Patent Application Laid-Open NO. 10-179215. This waist adjusting device comprises the adjusting belt 1', slider 2', operating piece, spring and attaching and fixing device 4'. The adjusting belt 1' has a multiplicity of adjusting protrusions 11' on the surface thereof and the slider 2' has a hollow through portion 20' through which the adjusting belt is capable of passing in the right and left direction. Further, an insertion portion is provided in which an operating piece can be inserted vertically and slid. Further, a partition wall is provided at a bottom portion inside to separate the adjusting belt from the operating piece and guide the operating piece. The operating piece comprises engaging protrusions 24' provided on one face thereof and an operating portion which can be pressed with pressure at an upper portion thereof. The operating piece is urged upward by a spring after it is inserted in the slider 2'. At normal time, the adjusting protrusions 11' engage the engaging protrusions 24' such that the adjusting belt 1' is fixed to the slider 2'. When the length of the waist is to be adjusted, the operating piece is pressed so as to release the engagement between the adjusting protrusions 11' and the engaging protrusions 24'. Then, by moving the slider, the length of the waist is adjusted.

However, in the waist adjusting device shown in FIG. 17, the slider is attached to a rear face of the waist belt located outside of the beltless trousers by means of the fixing device. The adjusting belt whose end is fixed to the waist belt inside or both the adjusting belt and common foundation are inserted through the slider and then, free ends of the adjusting belt or adjusting belt and common foundation are sewed and fixed to the waist belt located inside. Therefore, a work for attaching the waist adjusting device to clothes such as the beltless trousers is very complicated and troublesome.

Further, a well known waist adjusting device shown in FIG. 32 requires a large number of components and a slider of this waist adjusting device needs assembly steps thereby inducing an increased cost and requiring a large amount of time and labor. Because the slider includes the operating piece, an entire thickness increases so that an appearance of the waist adjusting device is poor and there is a feeling of disharmony during use thereof.

SUMMARY OF THE INVENTION

Accordingly, the present invention has been achieved to solve the above described problems and therefore, a first object of the present invention is to provide a waist adjusting device in which the number of components of a product is reduced and the slider does not assembly steps because of its simple structure, thereby reducing production cost thereof, the structure being simple and thin allowing adjustment operation to be carried out simply and having a good appearance and not a feeling of disharmony.

A second object of the present invention is to provide a waist adjusting device in which a vertical motion of the adjusting belt is restricted to carry out engagement and release between the adjusting belt and slider smoothly so that the adjustment of the length of the waist can be carried out securely.

A third object of the present invention is to provide a waist adjusting device in which the adjusting belt is maintained in a stabilized condition so as to ensure engagement between the adjusting belt and the slider.

A fourth object of the present invention is to provide a waist adjusting device capable of holding the adjusting belt always in a good appearance and stabilized condition within the slider.

A fifth object of the present invention is to provide a waist adjusting device in which the adjusting belt or both the adjusting belt and a narrow foundation are fixed to a waist belt located inside by sewing both ends of each thereof and the slider fixed to the waist belt located outside is attached to the adjusting belt inside whose both ends are previously fixed, by elastic deformation thereby making it possible to mount the waist adjusting device very easily.

A sixth object of the present invention is to provide a waist adjusting device which enables the slider to be attached easily and rapidly to the adjusting belt whose both ends are fixed.

A seventh object of the present invention is to provide a waist adjusting device in which a stopper is disposed as a wedge between a surface plate and a rear plate to prevent the surface plate and the rear plate of the slider from opening freely.

An eighth object of the present invention is to provide a waist adjusting device in which the slider can be divided to a base body and a lid body so that it can be attached to clothes such as beltless trousers easily and can be assembled also easily.

A ninth object of the present invention is to provide a waist adjusting device of a type appropriate for production and molding of the slider by defining a shape of the slider.

A tenth object of the present invention is to provide a waist adjusting device which can be simply produced and recycled by restricting material thereof to thermoplastic resin.

The other objects will be understood from a description below.

To achieve the above objects, according to a main aspect of the invention, there is provided a waist adjusting device, including an adjusting belt having a multiplicity of adjusting protrusions which protrude from a surface thereof, and a slider having a hollow through portion through which the adjusting belt is passed. The through portion includes engaging protrusions capable of engaging the adjusting protrusions of the adjusting belt when the adjusting belt is provided at any of up and down positions within the through portion. And a gap portion corresponding to at least the adjusting protrusions is provided above or below the adjusting belt when the adjusting belt is passed through. As a result, the number of the components of the waist adjusting device can be reduced and the structure of the slider is simplified, so that the assembly work is not necessary. Consequently, production cost can be reduced and further, for adjustment work, the slider only has to be moved in the vertical direction. Thus, the adjustment operation is carried out smoothly and a completed product is simple and thin. There is no feeling of disharmony during use thereof unlike the conventional product.

Preferably, a protruded contact portion which the adjusting protrusion makes contact with is provided above or below the engaging protrusion within the through portion of the slider with a gap corresponding to at least the adjusting protrusion. Consequently, the vertical movement of the adjusting belt with respect to the slider is restricted and the engagement therebetween can be released securely, so that the length of the waist can be adjusted smoothly.

And preferably, a restricting portion for restricting a vertical movement of the adjusting belt is provided to protrude into a gap portion provided at any one of up and down positions on a wall opposing the engaging protrusion within the through portion of the slider. Consequently, the movement of the adjusting belt into the gap portion is restricted so that the adjusting belt can be maintained in a stabilized condition and engagement between the slider and adjusting belt can be maintained securely.

Also preferably, a U-shaped tongue piece having an elasticity is provided at a position opposing the gap portion provided at any one of up and down positions on a wall opposing the engaging protrusion within the through portion of the slider while the tongue portion contains a protruded restricting portion for restricting a vertical movement of the adjusting belt. Consequently, the movement of the adjusting belt into the gap portion is usually restricted, and if necessary, the adjusting belt is allowed to be moved easily and smoothly. Further, the adjusting belt can be maintained in a stabilized condition and the engagement between the slider and the adjusting belt can be maintained securely.

Preferably, the contact portion is disposed at a slightly higher position than the restricting portion of a wall opposing the restricting portion, the contact portion and the restricting portion being disposed within the through portion of the slider. Consequently, the adjusting belt can be always held in the stabilized condition and a waist adjusting device having a good appearance can be finished.

Further preferably, the slider is provided with a gap portion in one of a top plate and a bottom plate connecting the surface plate and the rear plate which have an elasticity, in particular. Consequently, part of the slider can be separated and opened easily. The slider can be attached to the adjusting belt whose both ends are fixed already, so that a later-attachment type of the slider is completed. Thus, productivity of clothes such as beltless trousers and skirt can be improved.

Further preferably, the gap portion provided in the slider is formed so as to extend in an entire range of the top plate or bottom plate while the surface plate just opposes the rear plate at the position in which the gap portion exists. Consequently, the slider can be attached to the adjusting belt whose both ends are fixed, very easily, simply and rapidly.

Still further preferably, a stopper insertion hole is provided on the top plate or the bottom plate; the stopper is formed of a plate bent in a U-shape having U-shaped leg portions elastically deformable at one end and engaging portions directed outward provided on ends of the leg portions so that the engaging portions are capable of engaging the stopper insertion hole and the other end of the stopper is formed so as to nip the surface plate. Consequently, the surface plate and rear plate of the slider can be maintained in a stabilized condition so that a smooth adjustment work can be carried out.

Further preferably, the slider is comprised of a surface plate capable of being fixed to the waist belt and the rear plate capable of engaging the surface plate and fitting pieces are provided on any one of the surface plate and the rear plate while engaging pieces capable of engaging the fitting pieces are provided on the other side, each of the fitting pieces and the engaging pieces opposing vertically, the through portion being formed between the surface plate and the rear plate. Consequently, the slider can be produced and installed very simply and particularly a slider suitable for molding processing of thermoplastic resin can be produced. Further, the aforementioned later-installation type can be applied to the waist adjusting device composed of a small number of parts and not requiring a complicated adjustment work.

Further preferably, the fitting piece has a hook-shaped fitting portion and the engaging piece has a hook-shaped engaging portion provided at a front end thereof. Consequently, the surface plate and rear plate of the slider can be maintained in a stabilized condition, so that a smooth adjustment operation can be carried out.

Further preferably, the slider has a rectangular shape and a rectangular through hole is provided in a vertical direction of the center of the rear plate and an attaching hole whose inner side is expanded is provided in the surface plate opposing the through hole, while a fixing device for attaching the slider onto the waist belt is a cap having attaching posts protruded, the attaching posts being inserted into the attaching holes and crushed. Consequently, production and attachment of the slider can be carried out very simply and a slider suitable for, in particular, molding processing of thermoplastic resin can be produced.

Further, the adjusting belt, slider and fixing device are formed of thermoplastic resin. Consequently, the waist adjusting device can be produced very simply and recycled.

DESCRIPTION OF THE PREFERRED EMBODIMENTS

Hereinafter, the preferred embodiments of a waist adjusting device of the present invention will be described with reference to the accompanying drawings.

Figure 1:
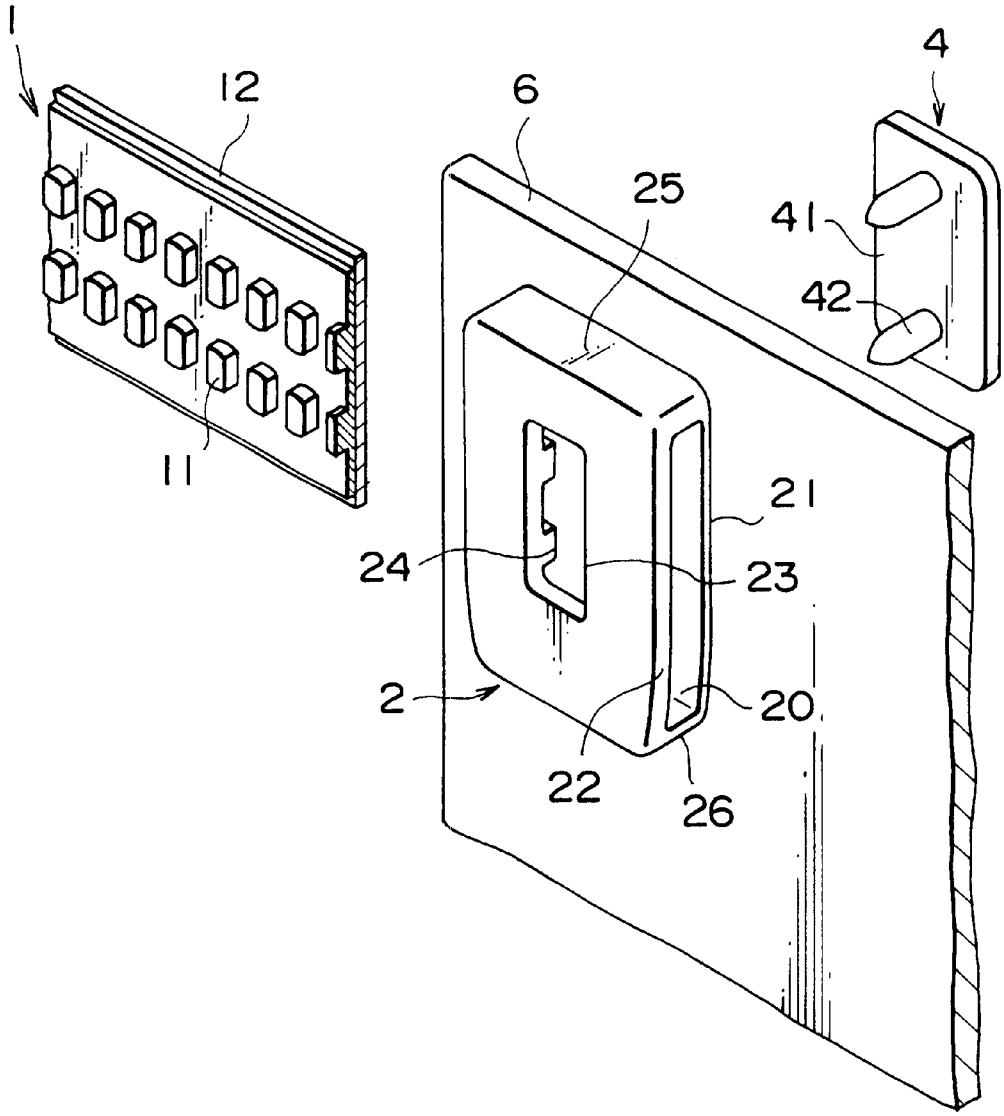
FIG. 1 is an exploded perspective view of a waist adjusting device according to a first embodiment of the invention.
Figure 16:
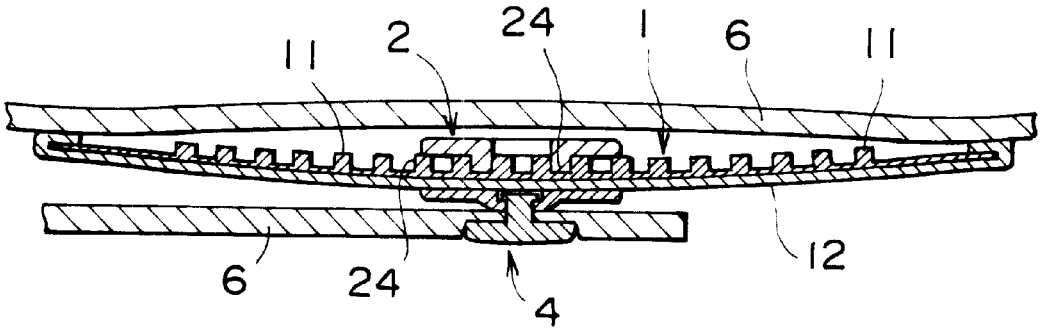
FIG. 16 is a lateral sectional view showing use condition of a waist adjusting device.
Figure 17:
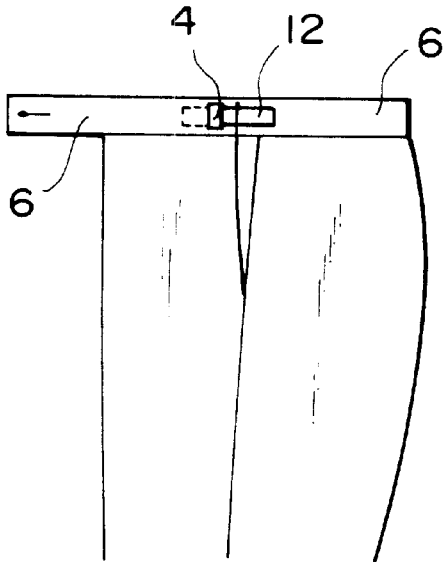
FIG. 17 is a front view showing use condition of a waist adjusting device.

The waist adjusting device of the present invention comprises an adjusting belt 1, a slider 2 and a fixing device 4 as shown in FIG. 1. With these three parts, the length of a waist belt 6 can be adjusted. The slider 2 is attached to an inside of an end portion of the waist belt 6 of beltless trousers or the like as shown in FIGS. 16 and 17 by means of the fixing device 4. Both ends of a narrow foundation 12 are attached to the waist belt 6 and the adjusting belt 1 is attached on a rear face of the narrow foundation 12. The narrow foundation 12 is inserted through the slider 2 such that the slider 2 is capable of sliding therealong so as to adjust the waist length of the waist belt 6. The adjusting belt 1, the slider 2 and the fixing device 4 are formed by injection molding or extrusion using such thermoplastic resin as polyamide, polyacetal, polypropylene and polybutylene terephthalate.

Meanwhile, if the adjusting belt 1 is formed thick, it is not always necessary to attach the narrow foundation 12 to the adjusting belt 1. The adjusting belt 1 may be attached solely to the waist belt 6. Further, if the adjusting belt 1 is made in the same color as the textile of the waist belt 6, the adjusting belt 1 is unobtrusive in the appearance, which is preferable.

Figure 4:
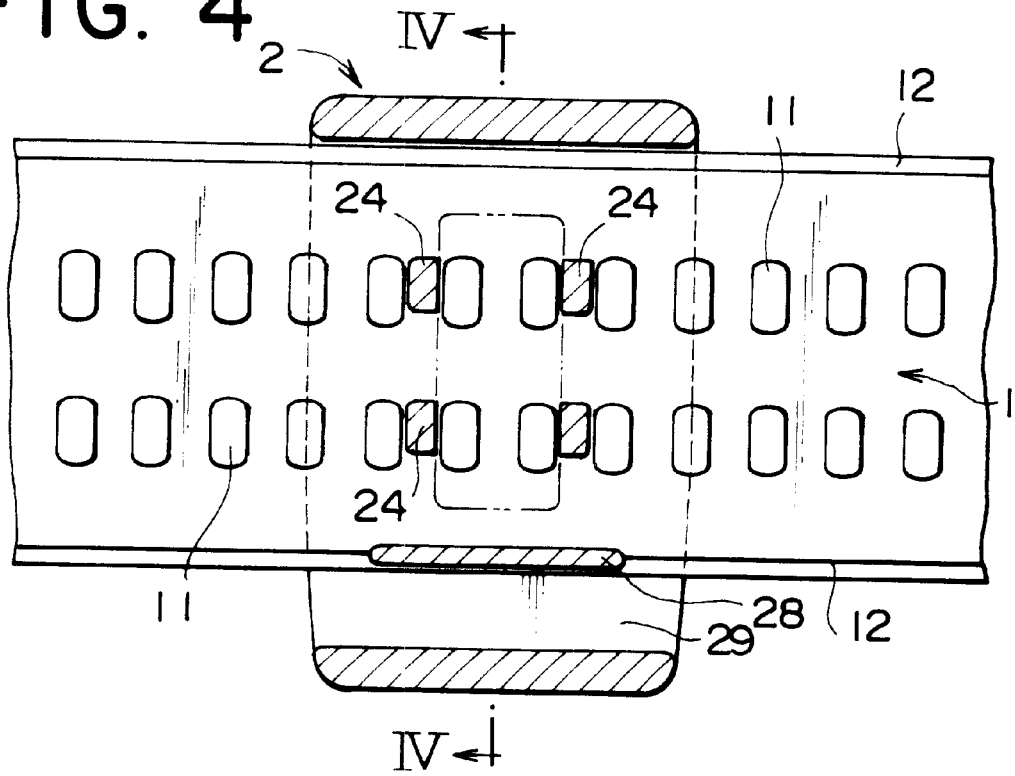
FIG. 4 is a sectional view taken along the line III—III of FIG. 5 of the waist adjusting device.
Figure 5:
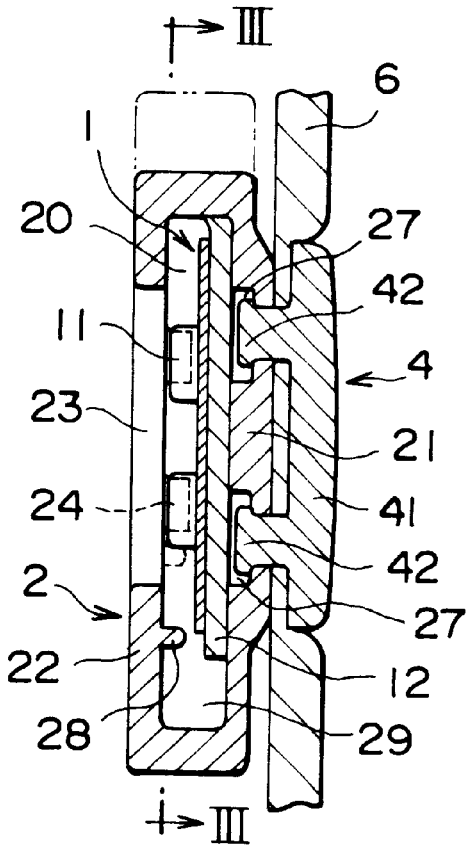
FIG. 5 is a sectional view taken along the line IV—IV of FIG. 4 of the waist adjusting device.
Figure 6:
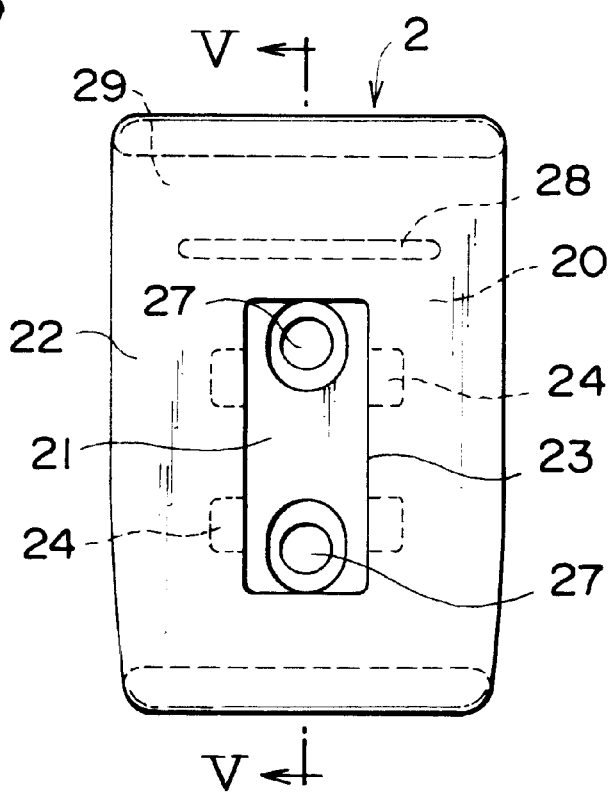
FIG. 6 is a front view of the slider of the waist adjusting device according to a second embodiment of the invention.
Figure 7:
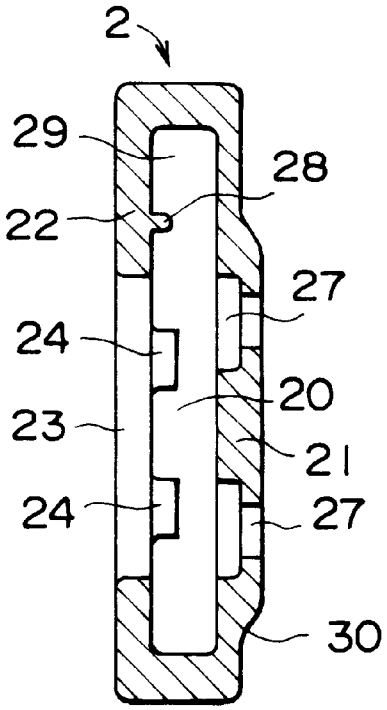
FIG. 7 is a sectional view taken along the line V—V of FIG. 6 of the slider of the waist adjusting device.
Figure 8:
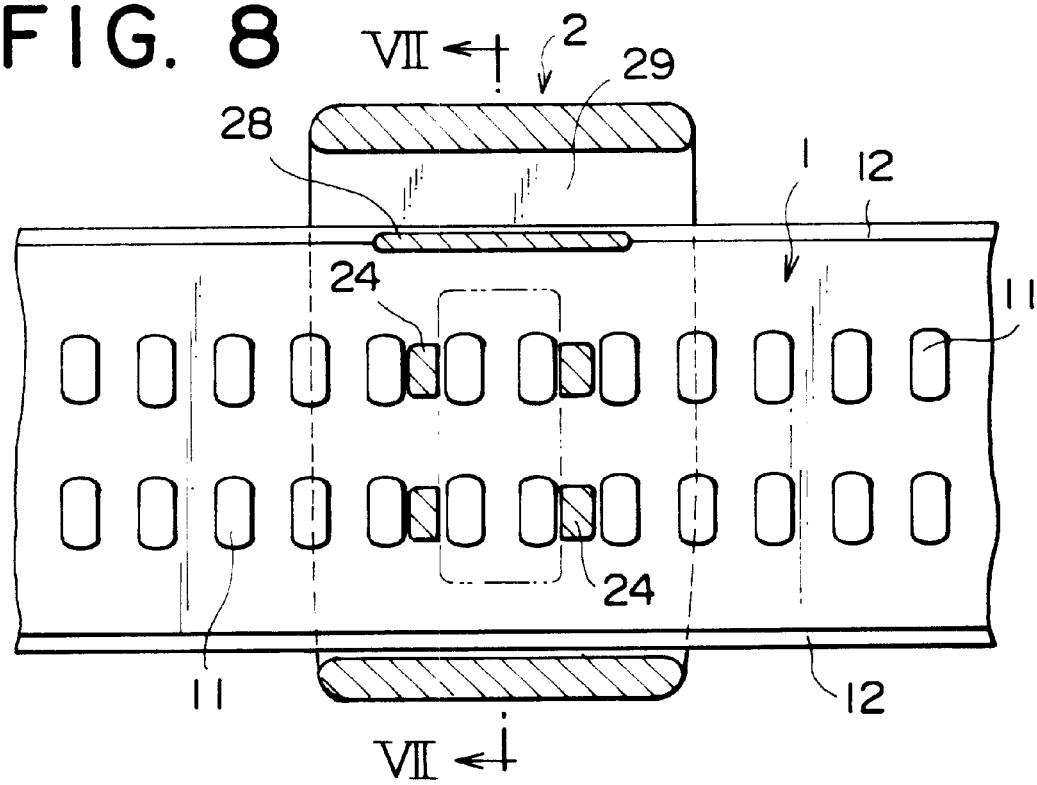
FIG. 8 is a sectional view taken along the line VI—VI of FIG. 9 of the waist adjusting device.

As shown in FIGS. 1, 4 and 5, the adjusting belt 1 of the waist adjusting device is a long belt, which has two rows of adjusting protrusions 11 disposed at an equal interval on the surface thereof. This adjusting protrusion 11 is formed in a rectangular shape, a vertically long hexagon or any shape in which both sides are parallel to each other. The adjusting belt 1 entirely has an elasticity while the rear face thereof is flat, so that it has a configuration appropriate for being attached to the narrow foundation 12 of the waist belt 6 of trousers, skirt or the like.

Figure 2:
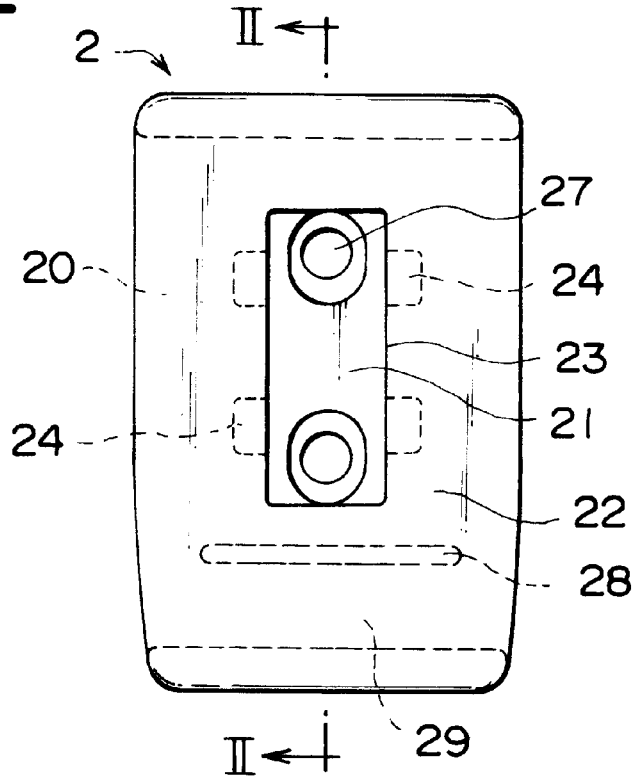
FIG. 2 is a front view of a slider of the waist adjusting device of FIG. 1.
Figure 3:
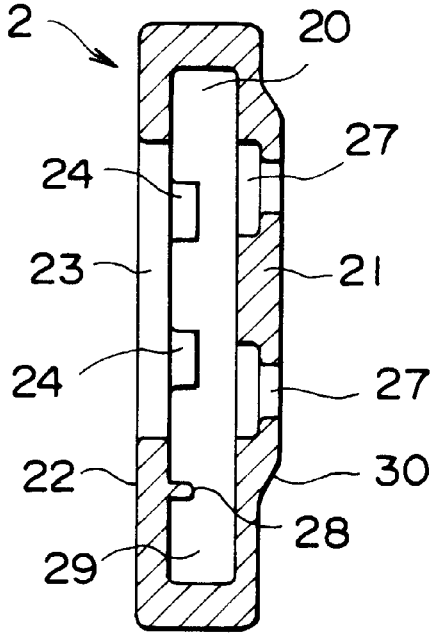
FIG. 3 is a sectional view taken along the line II—II of FIG. 2 of the slider of the waist adjusting device.

As shown in FIGS. 1 to 3, the slider 2 of the waist adjusting device has a hollow through portion 20, which is rectangular as a whole with both the right and left side walls open so that the adjusting belt 1 can be inserted therethrough. A vertically long rectangular through hole 23 is provided in the center of a rear plate 22 of the slider 2. Two engaging protrusions 24 are provided vertically on an inside face of each of both sides of the through hole 23 such that they can engage the adjusting protrusions 11 of the adjusting belt 1. Further, a protruding contact portion 28 is provided on an inside face of the bottom of the through hole 23 such that when the adjusting belt 1 is moved downward, it makes contact with the adjusting protrusions 11 so as to restrict an excessive move of the adjusting protrusions 11 and further it ensures to release the engagement between the engaging protrusions 24 and the adjusting protrusions 11. A gap portion 29 is provided below this contact portion 28 so that the adjusting belt 1 and the narrow foundation 12 are capable of moving therethrough.

When the adjusting belt 1 is located up in the slider 2, the adjusting protrusions 11 of the adjusting belt 1 engage the engaging protrusion 24 of the slider 2 such that they overlap each other in the right/left direction, so as to prevent the adjusting belt 1 and the slider 2 from moving relatively in the right/left direction. Further, when the adjusting belt 1 is located down in the slider 2, namely in the gap portion 29, the adjusting protrusion 11 of the adjusting belt 1 does not overlap the engaging protrusion 24 of the slider 2 in the right/left direction, so that the engagement therebetween is released. Consequently, the adjusting belt 1 and the slider 2 can be moved relatively in the right/left direction. The contact portion 28 is provided so as to protrude with a gap equal to at least the adjusting protrusion 11 below the engaging protrusion 24, so that the adjusting protrusion 11 is capable of moving freely in the right/left direction along the contact portion 28.

As shown in FIGS. 2 and 3, a vertical pair of attaching holes 27 each having a T-shaped section or a tapered section whose inner side is expanded are provided in a surface plate 21 in a range corresponding to the through hole 23 provided in the rear plate 22 of the slider 2. An attaching post 42 of the fixing device 4 is inserted into each of the attaching holes 27 and then, an end of the attaching post 42 is crushed by pressing appropriately using the through hole 23 of the rear plate 22 so as to fix the slider 2 on the waist belt 6. A surrounding portion around the attaching hole 27 is formed thick so that a protruding portion 30 is provided to protrude to the side of the surface. As shown in FIG. 5, the protruding portion 30 and a cap 41 of the fixing device 4 cooperate to hold the waist belt 6 firmly as shown in FIG. 5.

As shown in FIG. 2, an external shape of the slider 2 is formed asymmetrically such that an upper section thereof is wide while a lower section thereof is slightly narrow. This configuration is determined to prevent the slider 2 from being attached in a wrong direction relative to the waist belt 6 so as to ensure convenience for attachment work of the slider 2.

In the fixing device 4 of the waist adjusting device, as shown in FIGS. 1 and 5, the rear face of the cap 41 has two attaching posts 42 having sharp ends, which are provided vertically at an interval corresponding to the upper and lower attaching holes 27 provided in the surface plate 21 of the slider 2. After the attaching posts 42 are pierced through the waist belt 6 and inserted into the attaching holes 27, the end thereof is crushed within the attaching hole 27 by pressing so that the attaching hole 27 is filled with crushed portion thereof so as to fix the waist adjusting device.

In attaching the waist adjusting device, the slider 2 is attached to an rear face of the end portion of the waist belt 6 outside of the beltless trousers, skirt or the like as shown in FIGS. 16 and 17. At this time, the attaching posts 42 of the fixing device 4 are pierced from the surface of the waist belt 6 and inserted into the attaching holes 27 provided in the surface plate 21 of the slider 2. After that, by crushing the end portion by pressing, the slider 2 is attached to the waist belt 6. The adjusting belt 1, or if the adjusting belt 1 is attached to the rear face of the narrow foundation 12, the adjusting belt 1 and narrow foundation 12 are inserted into the slider 2, and then both ends of the adjusting belt 1 or the narrow foundation 12 are sewed to an inside face of the waist belt 6. Consequently, a void is generated in the intermediate portion of the adjusting belt 1 so that the adjusting belt 1 is separable from the waist belt 6.

Although it is permissible that an end appearing on the surface of the adjusting belt 1 or the narrow foundation 12 is sewed and a hidden end is made free, both ends of the adjusting belt 1 or the narrow foundation 12 should be fixed to facilitate the adjustment of the waist. When the narrow foundation 12 is used, it is preferred that by using the narrow foundation 12 having a slightly larger width than the adjusting belt 1, the adjusting belt 1 is covered thereby in viewpoints of the appearance.

Upon adjustment of the waist adjusting device attached on the waist belt 6, first of all, in order to release the engagement between the engaging protrusion 24 of the slider 2 and the adjusting protrusions 11 of the adjusting belt 1, the waist belt 6 having the slider 2 is pulled up together with the slider 2 as indicated by two dots line shown in FIG. 5 and moved until the adjusting protrusions 11 make contact with the contact portion 28. Consequently, the engagement between the engaging protrusions 24 and the adjusting protrusions 11 is released. Then, the slider 2 is slid in the right and left direction to adjust the length of the waist. Then, the waist belt 6 is pulled down together with the slider 2 and moved to its original position so that the adjusting protrusion 11 engages the engaging protrusion 24 so as to adjust the length of the waist.

In the waist adjusting device according to a second embodiment of the invention shown in FIGS. 6 to 9, the through hole 23, engaging protrusion 24 and the contact portion 28 in the rear plate 22 of the slider 2, and protruding portion 30, attaching hole 27 in the surface plate 21, and the gap portion 29 are disposed at inverted positions in vertical direction with respect to the waist adjusting device of the first embodiment. Meanwhile, the same adjusting belt 1 in the same shape as the first embodiment is used.

Figure 9:
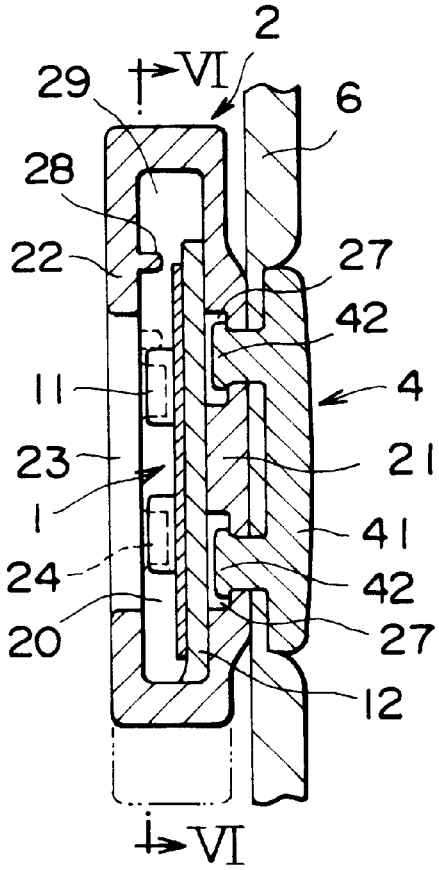
FIG. 9 is a sectional view taken along the line VII—VII of FIG. 8 of the waist adjusting device.

Upon adjustment of the length of the waist, in order to release the engagement between the engaging protrusion 24 of the slider 2 and the adjusting protrusions 11 of the adjusting belt 1, the waist belt 6 having the slider 2 is pulled down together with the slider 2 as indicated by two dots line shown in FIG. 9, and then moved to release the engagement between the engaging protrusion 24 and the adjusting protrusion 11. Then, the slider 2 is slid in the right and left direction to adjust the length of the waist. Then, the waist belt 6 is pulled up together with the slider 2 so as to engage the adjusting protrusions 11 with the engaging protrusions 24 for adjustment.

Figure 10:
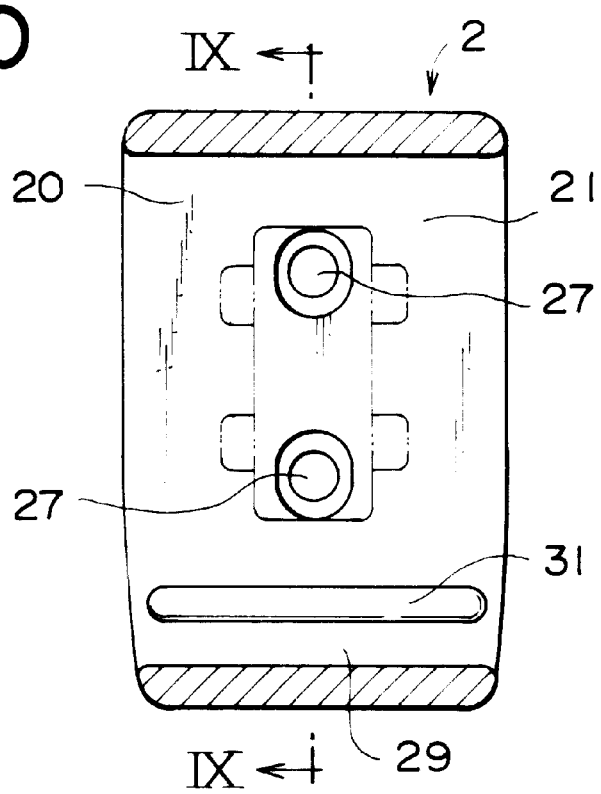
FIG. 10 is a sectional view taken along the line VIII—VIII of FIG. 11 of the slider of the waist adjusting device according to a third embodiment of the invention.
Figure 11:
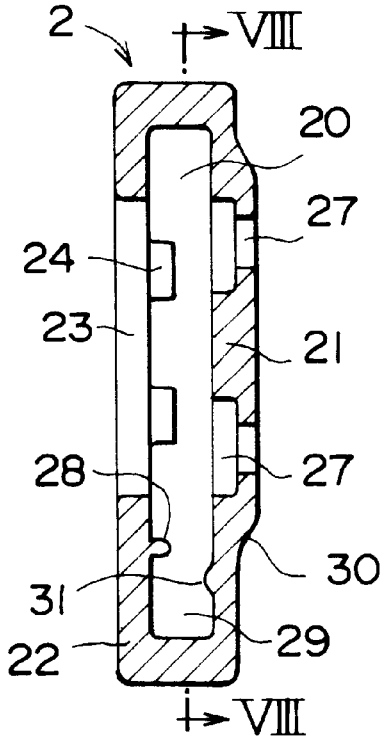
FIG. 11 is a sectional view taken along the line IX—IX of FIG. 10 of the slider of the waist adjusting device.
Figure 12:
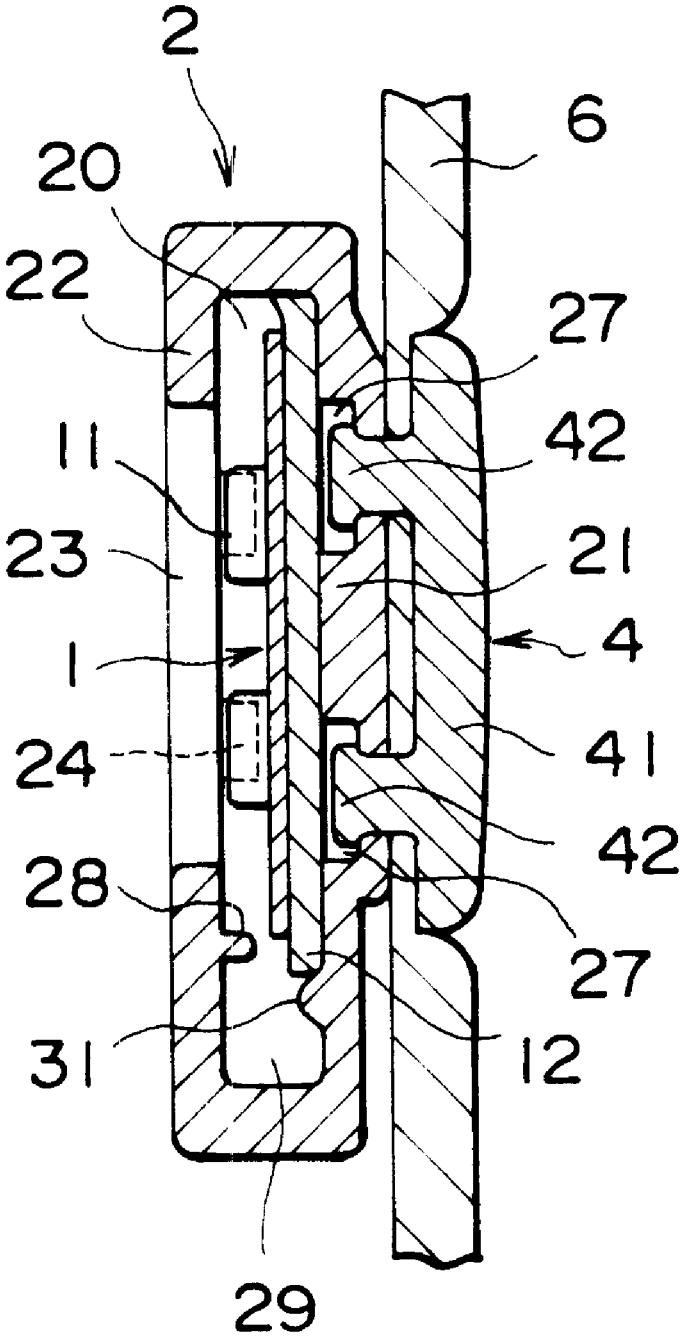
FIG. 12 is a longitudinal sectional view showing use condition of the waist adjusting device of the third embodiment.

The waist adjusting device according to a third embodiment of the invention shown in FIGS. 10 to 12 has the same configuration as the waist adjusting device of the first embodiment except that the configuration of the inner face of the surface plate 21 of the slider 2 is slightly different from the first embodiment. That is, to restrict the adjusting belt 1 whose ends are attached to the waist belt 6 or narrow foundation 12 and the adjusting belt 1 from dropping, a protruding restricting portion 31 is provided on a lower part of an inner face of the surface plate 21. Consequently, the narrow foundation 12 is restricted from dropping down as shown in FIG. 12, so that engagement between the engaging protrusion 24 and the adjusting protrusion 11 can be maintained securely.

Meanwhile, the restricting portion 31 should be formed slightly lower than the contact portion 28 provided on an opposing wall of the slider 2 or an inner face of the rear plate 22 so as to capture the common foundation 12. Further, it is permissible to provide the gap portion 29 in an upper part of the slider 2 so that the waist belt 6 can be pulled down.

Upon adjustment of the length of the waist, to release the engagement between the engaging protrusions 24 of the slider 2 and the adjusting protrusions 11 of the adjusting belt 1, the waist belt 6 having the slider 2 is pulled up together with the slider 2 against a restriction of the restricting portion 31 and then lower edges of the narrow foundation 12 and adjusting belt 1 are introduced into the gap portion 29 and moved until the adjusting protrusion 11 makes contact with the contact portion 28. Consequently, the engagement between the engaging protrusions 24 and the adjusting protrusion 11 is released and the slider 2 is slid in the right and left direction to adjust the length of the waist. After that, the waist belt 6 is pulled down together with the slider 2 to engage the adjusting protrusions 11 with the engaging protrusions 24.

Figure 13:
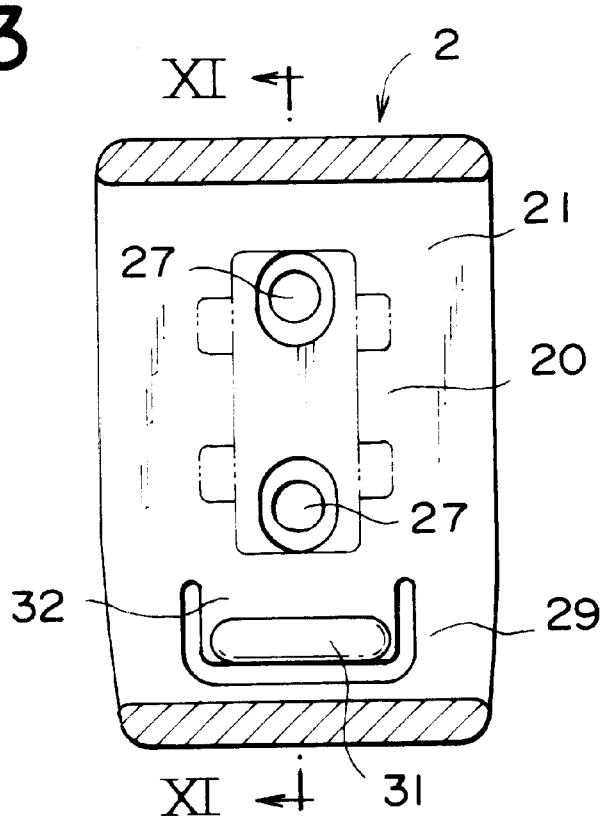
FIG. 13 is a sectional view taken along the line X—X of FIG. 14 of the slider of the waist adjusting device according to a fourth embodiment of the invention.
Figure 14:
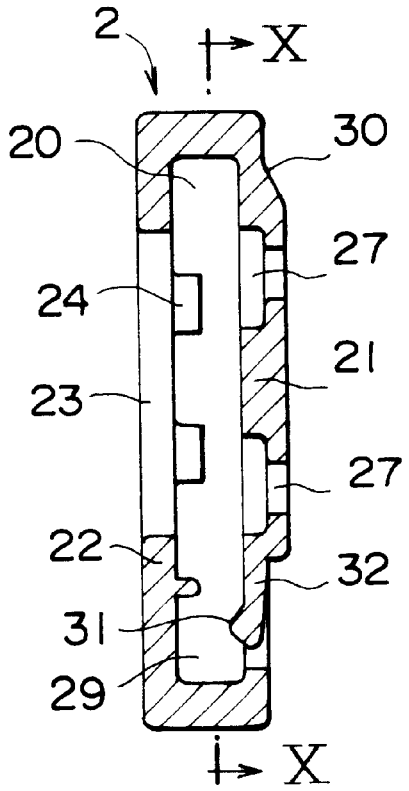
FIG. 14 is a sectional view taken along the line XI—XI of FIG. 13 of the slider of the waist adjusting device.
Figure 15:
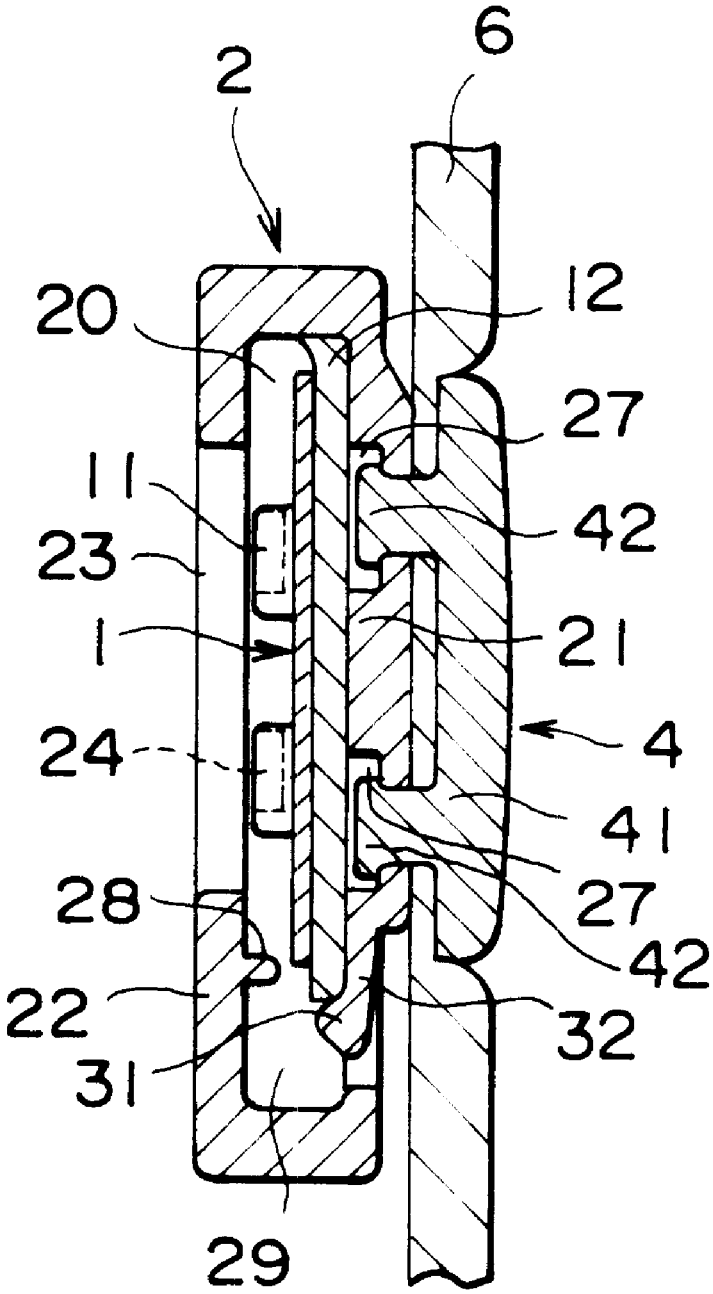
FIG. 15 is a longitudinal sectional view showing use condition of the waist adjusting device of the fourth embodiment.

The waist adjusting device according to a fourth embodiment of the invention shown in FIGS. 13 to 15 has the same configuration except that the configuration of the restricting portion 31 provided on an inner face of the surface plate 21 of the slider 2 of the waist adjusting device of the third embodiment is different. That is, a wide U-shaped tongue piece 32 is provided below the attaching holes 27 of the surface plate 21 and the restricting portion 31 protruded inward is provided at an end of this tongue piece 32 to provide the restricting portion 31 with an elasticity. Consequently, an operation for moving the adjusting belt 1 or common foundation 12 and adjusting belt 1 beyond the restricting portion 31 can be carried out smoothly.

Adjustment of the waist length in this waist adjusting device is carried out in the same manner as the waist adjusting device of the aforementioned third embodiment.

To release the engagement between the engaging protrusions 24 of the slider 2 and the adjusting protrusions 11 of the adjusting belt 1, the waist belt 6 having the slider 2 is pulled up together with the slider 2 being against and overcoming the restriction of the restricting portion 31. Then, the restricting portion 31 is retracted by its elasticity, so that introduction of the adjusting belt 1 or the narrow foundation 12 and adjusting belt 1 into the gap portion 29 is facilitated. The adjusting belt 1 or the narrow foundation 12 and the adjusting belt 1 are moved easily until the adjusting protrusion 11 makes contact with the contact portion 28 so as to release the engagement between the engaging protrusions 24 and the adjusting protrusions 11. Then, the slider 2 is slid in the right and left direction to adjust the length of the waist. After that, the waist 6 is pulled down together with the slider 2 so as to engage the adjusting protrusions 11 with the engaging protrusions 24.

FIGS. 18 to 24 show fifth and sixth embodiments having a different structure of the slider 2 from the above described embodiments. The fifth embodiment shown in FIGS. 18 to 21 comprises the adjusting belt 1, the slider 2, and the fixing device 4. The sixth embodiment shown in FIGS. 22 and 23 comprises the adjusting belt 1, the slider 2, the fixing device 4 and a stopper 5. These members are formed by injection molding or extrusion using such thermoplastic resin as polyamide, polyacetal, polypropylene and polybutylene terephthalate like the above described first to fourth embodiments so as to provide the slider 2 with an elasticity.

They will be described in detail with reference to the respective drawings. The waist adjusting device according to the fifth embodiment shown in FIGS. 18 to 21 has a long adjusting belt 1, which has two rows of the adjusting protrusions 11 at a predetermined interval on the surface thereof. This adjusting protrusion 11 is formed in a rectangular shape, vertically long hexagonal shape or any shape in which both sides are parallel to each other. The adjusting belt 1 has entirely an elasticity while a rear face thereof is flat.

If the adjusting belt 1 is formed thick, it is not always necessary to attach the narrow foundation 12 to the adjusting belt 1 and the adjusting belt 1 may be attached solely to the waist belt 6. Further, if the adjusting belt 1 is formed in the same color as the fabric of the waist belt 6, the adjusting belt 1 is unobtrusive in the appearance, which is preferable. Further, it is permissible to form a row of the adjusting protrusions 11 at a predetermined interval on the surface of the adjusting belt 1. Consequently, the adjusting belt 1, slider 2 and fixing device 4 can be reduced in size.

The slider 2 of the waist adjusting device is rectangular as a whole and a surface plate 21 and a rear prate 22 are connected with a top plate 25, while a bottom plate 26 is provided to be connected with the rear plate 22. A through portion 20 is formed between the surface plate 21 and the rear plate such that the adjusting belt 1 can be passed through in the right and left direction. The bottom plate 26 is separated from the surface plate 21 by providing a gap portion 33. Consequently, as indicated by two dots line of FIG. 19, the rear plate 22 can be elastically deformed to depart from the surface plate 21 with the top plate 25 as a base point so that the gap portion 33 is enlarged.

Thus, by providing this gap portion 33, the rear plate 22 can be opened relative to the surface plate 21 so that with this opening state, the slider 2 can be mounted on the adjusting belt 1 and the narrow foundation 12 so as to be attached to the adjusting belt 1. Meanwhile it is permissible to provide the gap portion 33 between the top plate 25 and the surface plate 21 so that the rear plate 22 can be opened with respect to the surface plate 21 through a top end with the bottom plate 26 as a base point by elastic deformation.

A vertically long rectangular through hole 23 is formed in the center of the rear plate 22 of the slider 2. Two engaging protrusions 24 are provided vertically on an inner face of each of both sides of this through hole 23 so that they are capable of engaging the adjusting protrusions 11 of the adjusting belt 1. A protruding contact portion 28 is provided on an inner face below the through hole 23 so that when the adjusting belt 1 is moved downward, it makes contact with the adjusting protrusions 11 so as to release the engagement with the adjusting protrusions 11 securely. Further, the gap portion 29 is provided below the contact portion 28 so that the adjusting belt 1 and the common foundation 12 can move therethrough.

When the adjusting belt 1 is located up in the slider 2, the adjusting protrusions 11 of the adjusting belt 1 engage the engaging protrusion 24 of the slider 2 such that they overlap each other in the right/left direction, so as to prevent the adjusting belt 1 and the slider 2 from moving relatively in the right/left direction. Further, when the adjusting belt 1 is located down in the slider 2, namely in the gap portion 29, the adjusting protrusion 11 of the adjusting belt 1 does not overlap the engaging protrusion 24 of the slider 2 in the right/left direction, so that the engagement therebetween is released.

Consequently, the adjusting belt 1 and the slider 2 can be moved relatively in the right/left direction. The contact portion 28 is provided so as to protrude with a gap equal to at least the adjusting protrusion 11 below the engaging protrusion 24, so that the adjusting protrusion 11 is capable of moving freely in the right/left direction along the contact portion 28.

Figure 19:
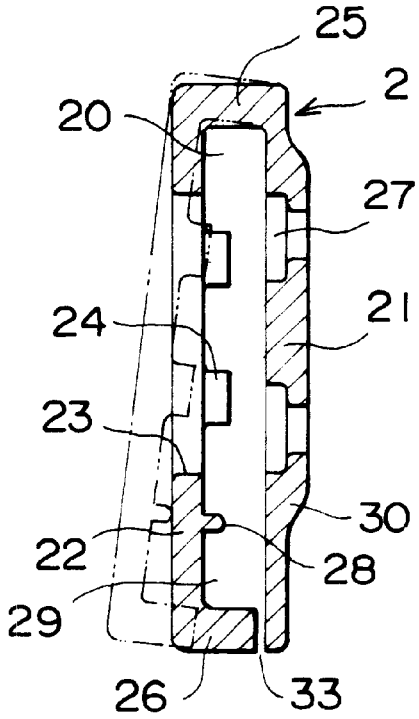
FIG. 19 is a sectional view of the slider of the waist adjusting device of FIG. 18.
Figure 20:
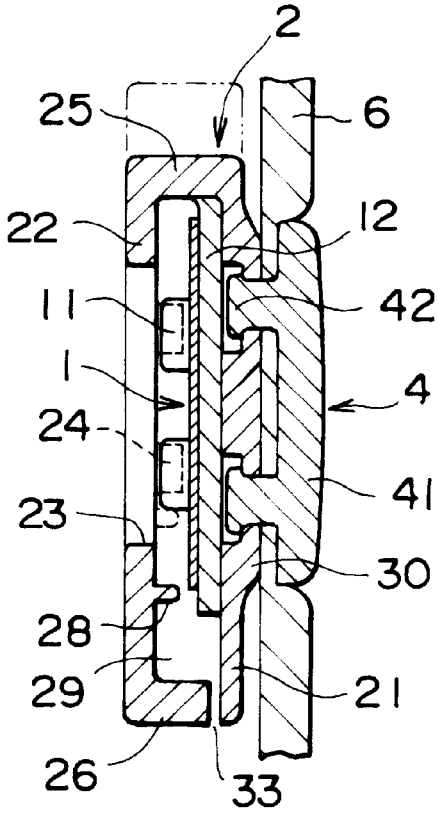
FIG. 20 is a sectional view of the waist adjusting device of FIG. 18.

As shown in FIG. 19, the vertical pair of attaching holes 27 each having a T-shaped section or a tapered section whose inner side is expanded are provided in a surface plate 21 opposing the through hole 23 provided in the rear plate 22 of the slider 2. An attaching post 42 of the fixing device 4 is inserted into each of the attaching holes 27 and then, an end of the attaching post 42 is crushed by pressing appropriately using the through hole 23 of the rear plate 22 so as to fix the slider 2 on the waist belt 6. A surrounding portion around the attaching hole 27 is formed thick so that a protruding portion 30 is provided to protrude to the side of the surface. As shown in FIG. 20, the protruding portion 30 and the cap 41 of the fixing device 4 cooperate to hold the waist belt 6 firmly as shown in FIG. 20.

Figure 18:
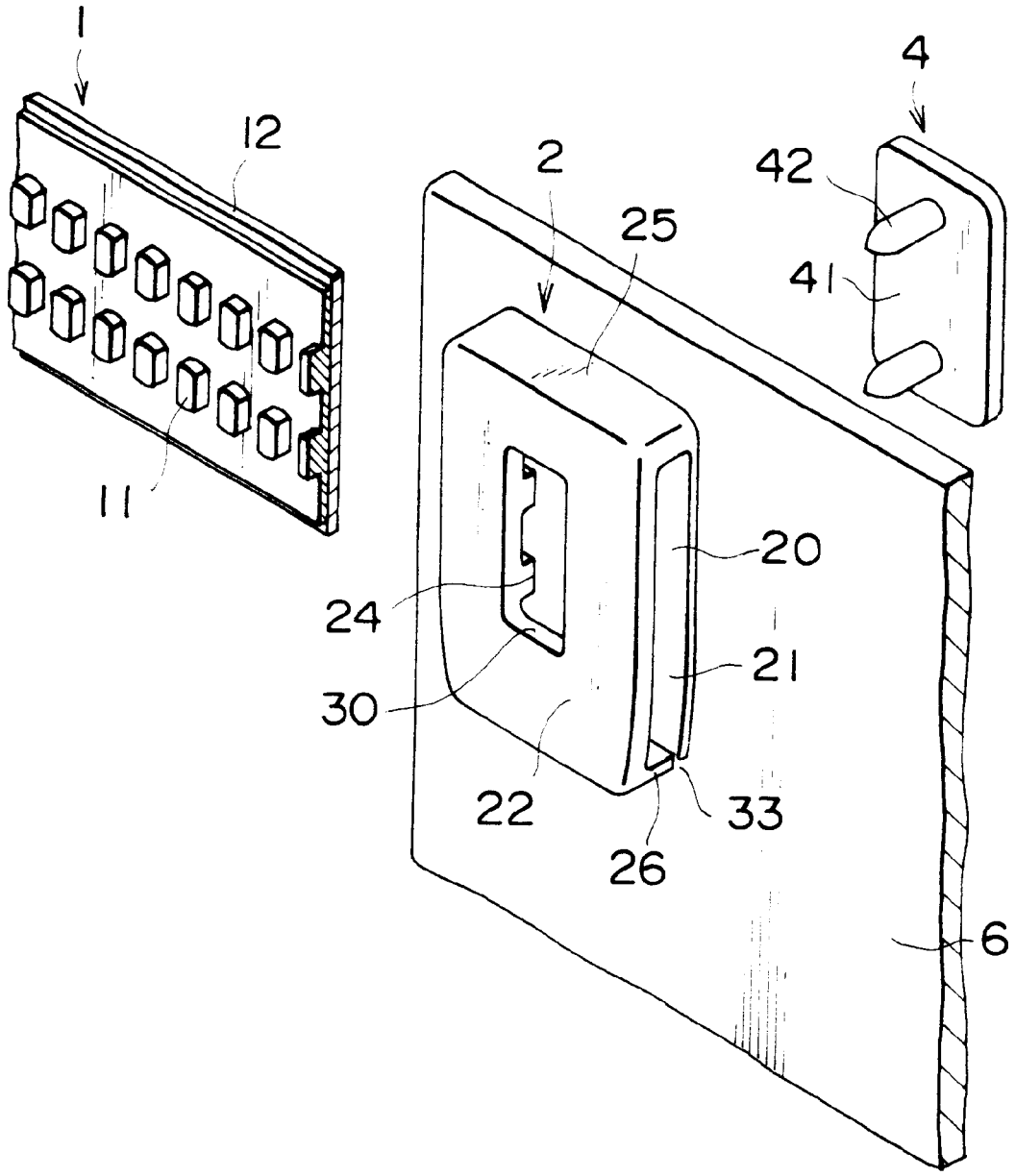
FIG. 18 is an exploded perspective view of the waist adjusting device according to a fifth embodiment of the invention.

As shown in FIG. 18, an external shape of the slider 2 is formed asymmetrically such that an upper section thereof is wide while a lower section thereof is slightly narrow. This configuration is determined to prevent the slider 2 from being attached in a wrong direction relative to the waist belt 6 so as to ensure convenience for attachment work of the slider 2.

In the fixing device 4 of the waist adjusting device, as shown in FIGS. 18 and 20, the rear face of the cap 41 has two attaching posts 42 having sharp ends, which are provided vertically at an interval corresponding to the upper and lower attaching holes 27 provided in the surface plate 21 of the slider 2. After the attaching posts 42 are pierced through the waist belt 6 and inserted into the attaching holes 27, the end thereof is crushed within the attaching hole 27 by pressing so that the attaching hole 27 is filled with crushed portion thereof so as to fix the waist adjusting device.

In attaching the waist adjusting device, similarly to the foregoing first embodiment, the slider 2 is attached to an rear face of the end portion of the waist belt 6 outside of the beltless trousers, skirt or the like as shown in FIGS. 16 and 17. At this time, the attaching posts 42 of the fixing device 4 are pierced from the surface of the waist belt 6 and inserted into the attaching holes 27 provided in the surface plate 21 of the slider 2. After that, by crushing the end portion by pressing, the slider 2 is attached to the waist belt 6. The adjusting belt 1 is fixed to the waist belt 6 together with the narrow foundation 12 by sewing both ends thereof to the waist belt 6 located inside, so that a gap portion is generated in the intermediate portion of the adjusting belt 1. Then, the slider 2 attached to the waist belt 6 is opened using the gap portion 33 of the slider 2 and attached on the adjusting belt 1 using the gap along the intermediate portion of the adjusting belt 1 and the narrow foundation 12 whose both ends are fixed, and pressed to sandwich the adjusting belt 1.

Upon adjustment of the waist adjusting device attached on the waist belt 6, first of all, in order to release the engagement between the engaging protrusion 24 of the slider 2 and the adjusting protrusions 11 of the adjusting belt 1, the waist belt 6 having the slider 2 is pulled up together with the slider 2 as indicated by two dots line shown in FIG. 20 and moved until the adjusting protrusions 11 make contact with the contact portion 28. Consequently, the engagement between the engaging protrusions 24 and the adjusting protrusions 11 is released. Then, the slider 2 is slid in the right and left direction to adjust the length of the waist. Then, the waist belt 6 is pulled down together with the slider 2 and moved downwardly to its original position so that the adjusting protrusion 11 engages the engaging protrusion 24 so as to adjust the length of the waist.

Figure 21:
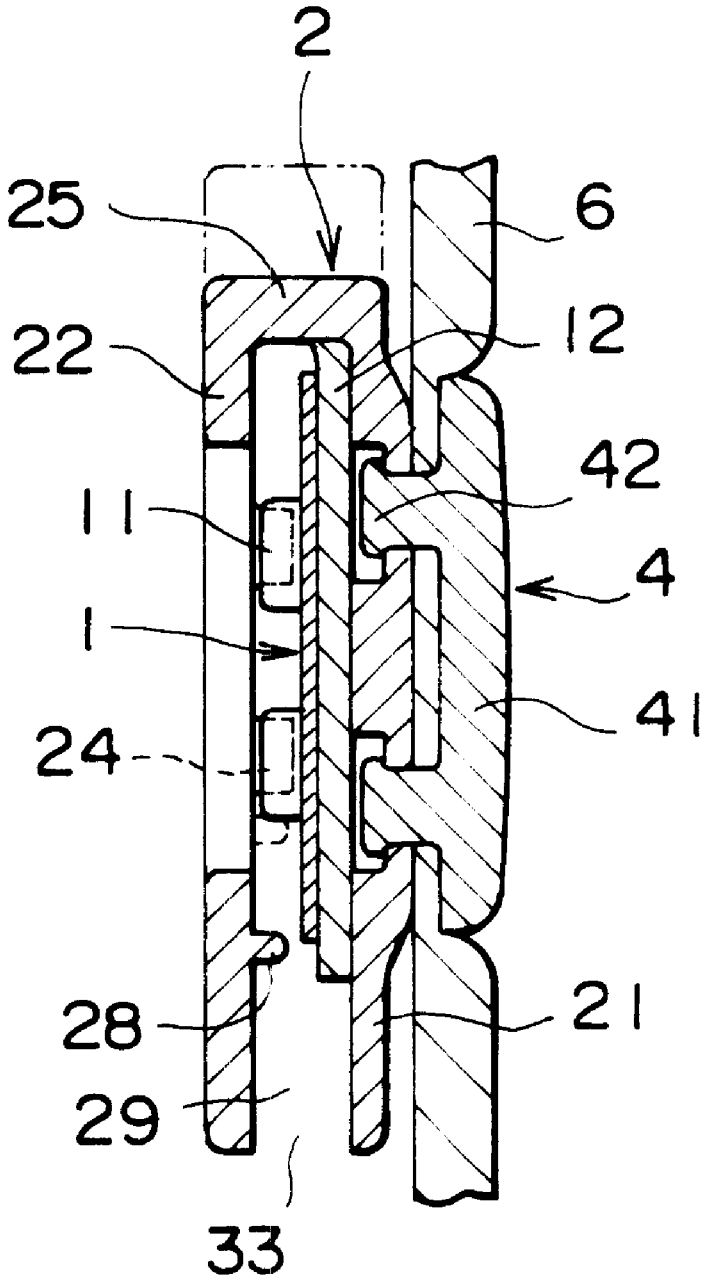
FIG. 21 is a sectional view showing a modification of the waist adjusting device of FIG. 18.

The waist adjusting device shown in FIG. 21 is a modification of the aforementioned embodiment. Although the top plate 25 for connecting the surface plate 21 and the rear plate 22 exists, the bottom plate 26 does not exist in an entire range. The surface plate 21 and the rear plate 22 are formed to simply oppose each other so that a wide gap portion 33 is generated at ends of the surface plate 21 and the rear plate 22. Consequently, if it is intended to fit the slider 2 onto the adjusting belt 1 whose ends are fixed, the surface plate 21 and the rear plate 22 are just opened and the adjusting belt 1 is just pressed in between the surface plate 21 and the rear plate 22. As a result, this assembly work can be carried out easily. Even if the bottom plate 26 does not exist, the adjusting belt 1 never slip away because the adjusting protrusions 11 keep contact with the contact portion 28 provided on the rear plate 22. Further, the adjustment of the length of the waist can be carried out easily like the aforementioned embodiments.

Figure 22:
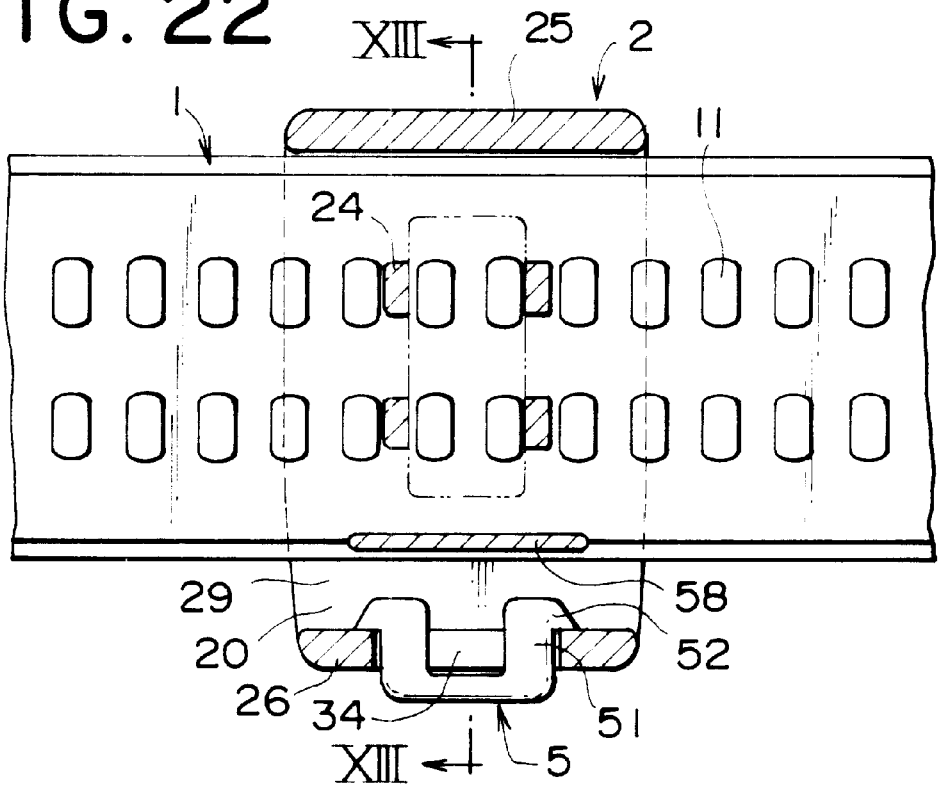
FIG. 22 is a sectional view taken along the line XII—XII of FIG. 23 of the waist adjusting device according to a sixth embodiment of the invention.
Figure 23:
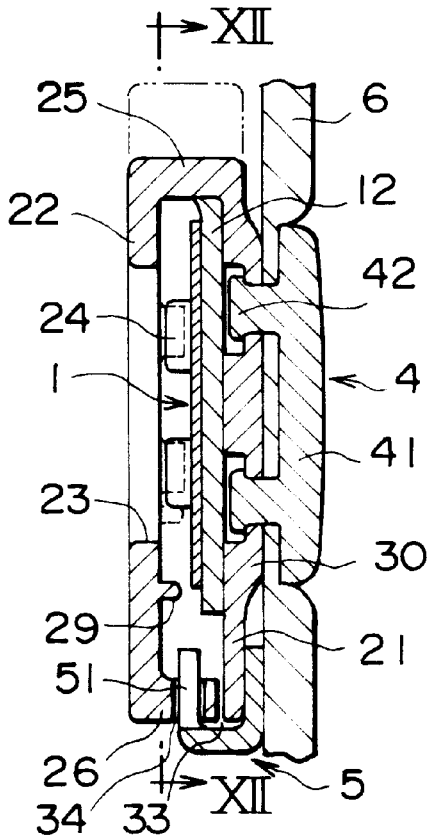
FIG. 23 is a sectional view taken along the line XIII—XIII of FIG. 22 of the waist adjusting device.

The waist adjusting device according to the sixth embodiment shown in FIGS. 22 and 23 has substantially the same structure of the slider 2 as the waist adjusting device of the aforementioned fifth embodiment, except that a rectangular insertion hole 34 is provided in the bottom plate 26 having the gap portion 33 so that the stopper 5 can be inserted thereinto. The stopper 5 is formed by bending a rectangular flat piece into a U shape, and providing U-shaped leg portions 51 elastically deformable on both sides thereof and then providing engaging portions 52 projecting outward in a triangular shape on each of front ends of the leg portions 51. As shown in FIG. 22, the stopper 5 is inserted into the insertion hole 34 in the bottom plate 26 and fixed thereon. Further, the other bent portion of the stopper 5 is fixed so as to nip the bottom portion of a protruded portion 30 of the surface plate 21 as shown in FIG. 23 such that the surface plate 21 and the rear plate 22 are never separated from each other easily. As a result, in this slider 2, a stabilized condition can be maintained. Meanwhile, the setting of the stopper 5 is carried out after the slider 2 is attached on the adjusting belt 1. Although the stopper 5 is formed by integral molding using thermoplastic resin, it may be formed of metal. If the gap portion 33 is provided in the top plate 25, the stopper 5 is disposed in the top plate 25 so as to nip the surface plate 21.

Figure 24:
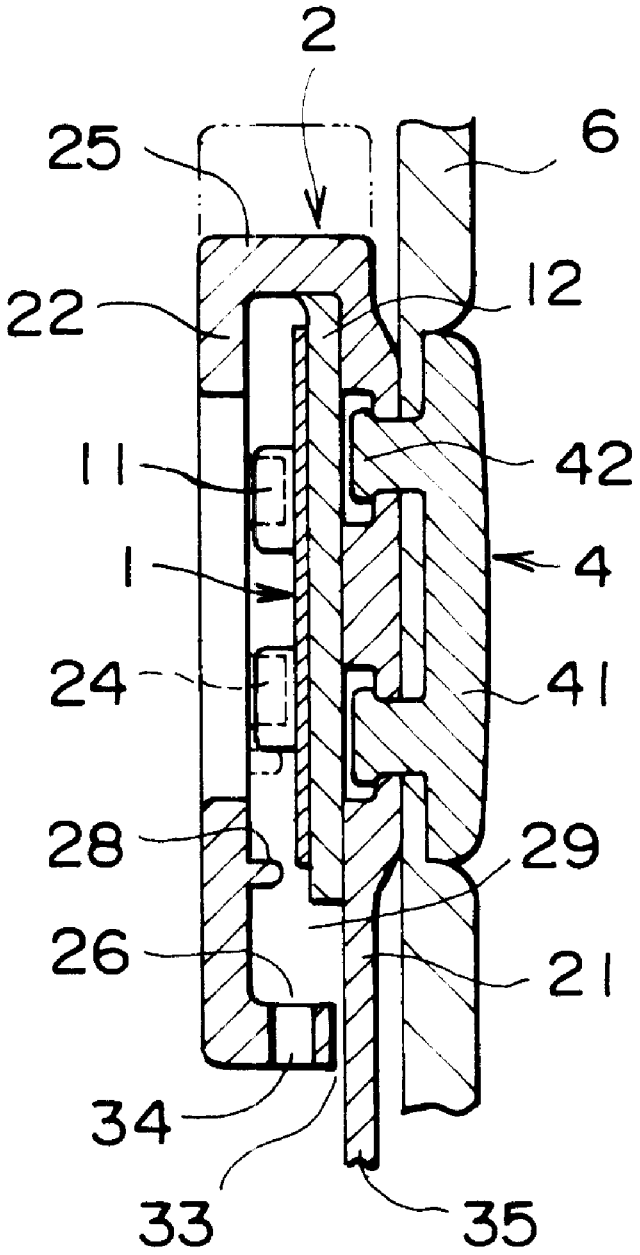
FIG. 24 is a sectional view showing a modification of the waist adjusting device of FIG. 22.

The waist adjusting device shown in FIG. 24 indicates a modification of the aforementioned embodiment. The stopper 5 is not provided separately from the slider 2. A narrow insertion tongue piece 35 having an expanding portion slightly expanding to both sides is formed integrally with the surface plate 21 such that it can be inserted into the insertion hole 34 in the bottom of the surface plate 21 of the slider 2. After the slider 2 is attached to the adjusting belt 1 using the gap portion 33, the insertion tongue piece 35 is inserted into the insertion hole 34 provided in the bottom plate 26 so as to seal the gap portion 33. Consequently, the opening of the gap portion 33 can be prevented.

Figure 25:
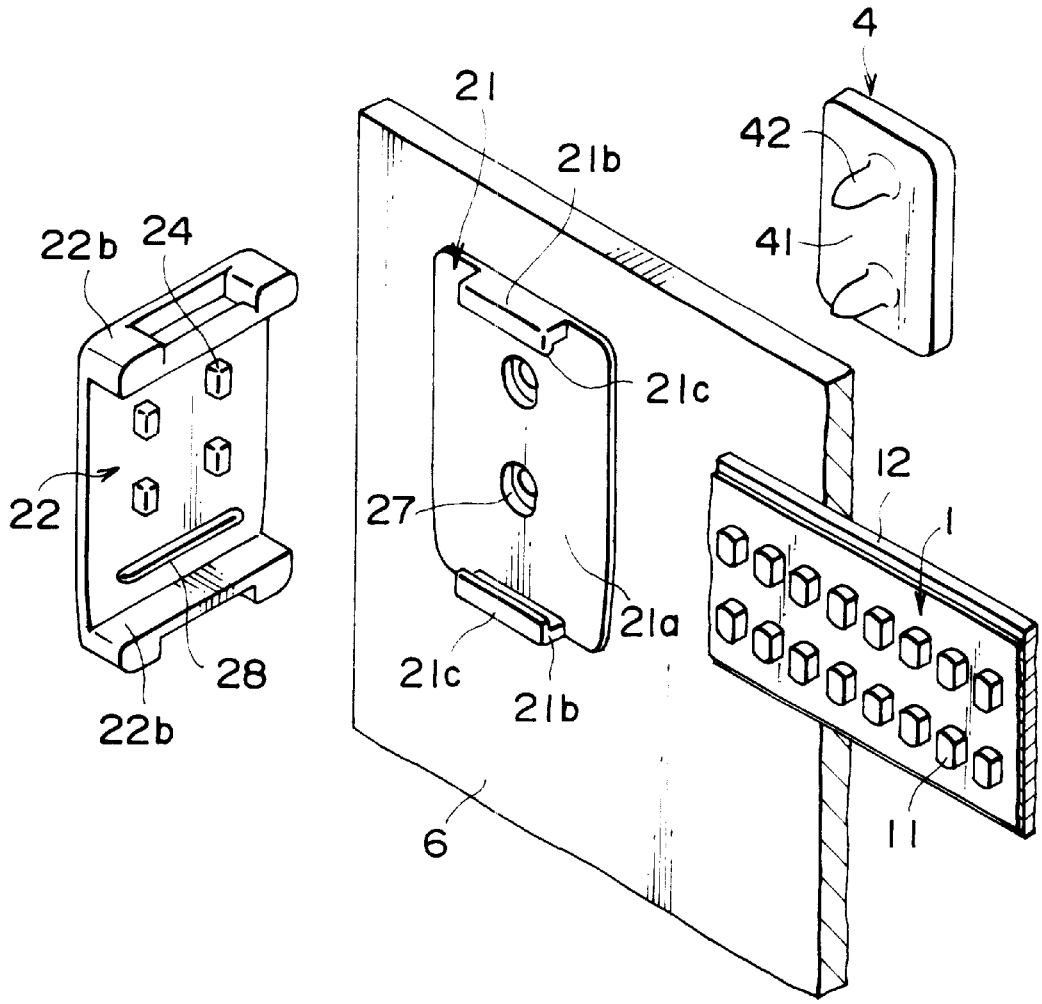
FIG. 25 is an exploded perspective view of the waist adjusting device of a seventh embodiment.
Figure 26:
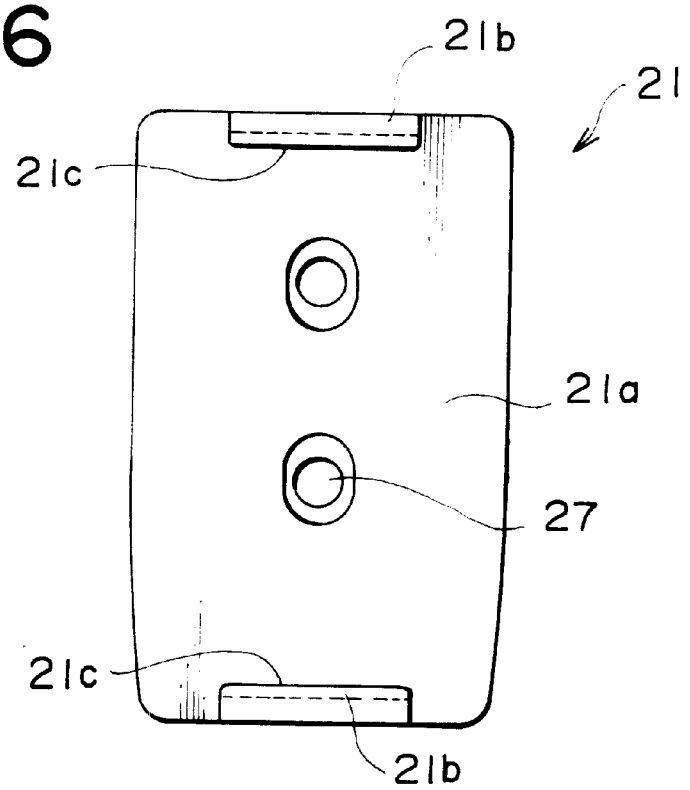
FIG. 26 is a front view of a base body of the waist adjusting device of FIG. 25.
Figure 27:
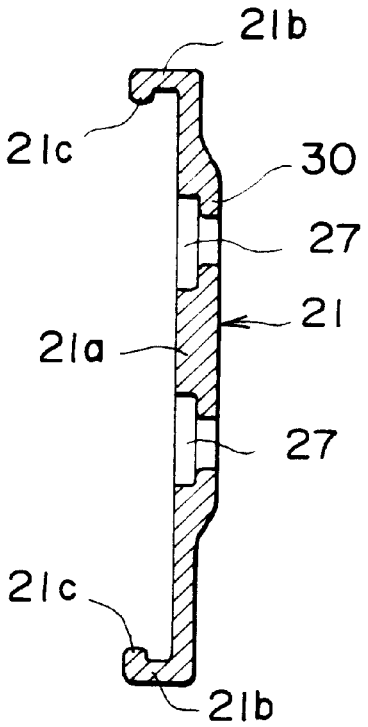
FIG. 27 is a sectional view of the base body of FIG. 26.

The slider 2 of the waist adjusting device according to a seventh embodiment of the invention shown in FIG. 25 comprises the surface plate 21 and the rear plate 22. This waist adjusting device is comprised of such a small number of components and other components are fixing device 4 and adjusting belt 1 only. As shown in FIGS. 26 and 27, the surface plate 21 has fitting pieces 21*b* provided on each of the top and bottom of a long main body 21*a* while an interval therebetween is longer than the width of the adjusting belt 1. A hook-shaped fitting portion 21*c* is provided at each front end of the fitting piece 21*b* and attaching holes 27 having a T-shaped section are provided in the center of the main body 21*a*. A surrounding portion around the attaching holes 27 up and down is formed in a protruding portion 30, in which the thickness is intensified.

Figure 28:
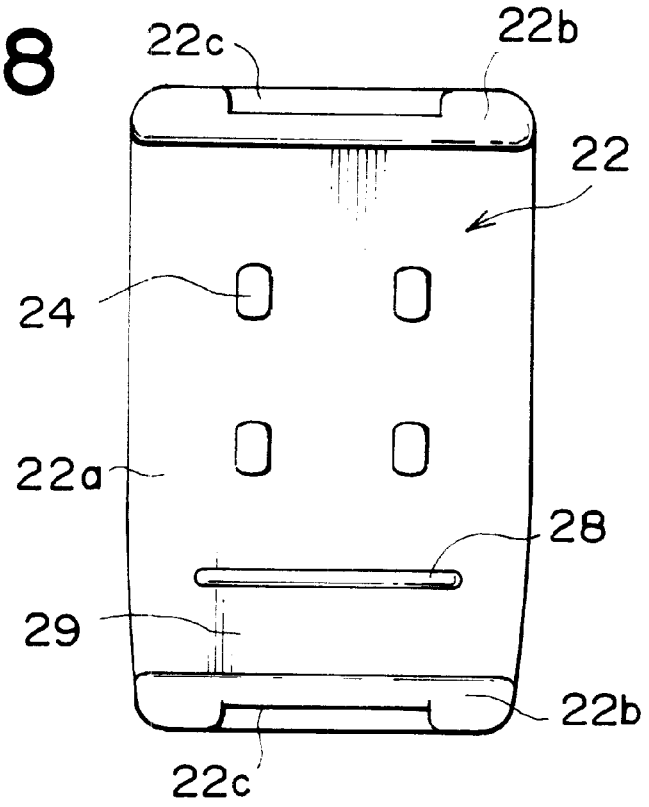
FIG. 28 is a front view of a lid body of the waist adjusting body of FIG. 25.
Figure 29:
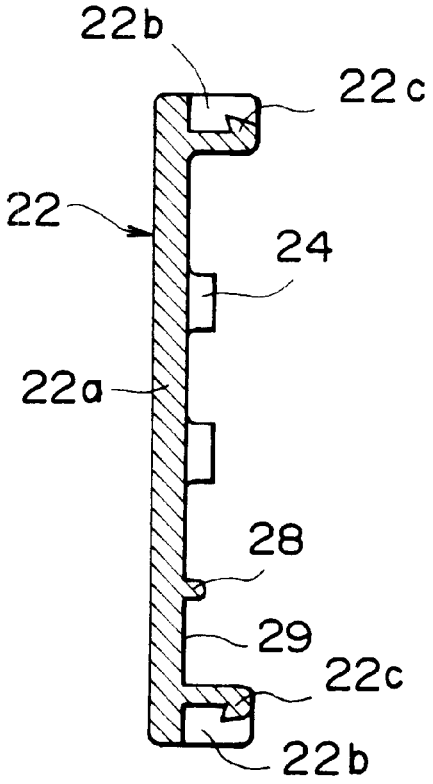
FIG. 29 is a sectional view of the lid body of FIG. 28.

In the rear plate 22 also, as shown in FIGS. 28 and 29, a main body 22*a* is long and engaging pieces 22*b* are provided vertically thereon. Then, a hook-shaped engaging portion 22*c* directed outward is formed at a front end of the engaging piece 22*b*. Two rows of the engaging protrusions 24 which engage the adjusting protrusions 11 are provided on the main body 22*a*. The gap portion 29 is provided above the lower engaging piece 22*b* and the contact portion 28 slightly protruded is provided on the main body 22*a*. The contact portion 28 is provided in such a position that when the adjusting belt 1 is moved so as to make contact with the engaging piece 22*b* at the bottom of the rear plate 22, the engagement between the adjusting protrusions 11 and the engaging protrusions 24 is released so that the adjusting protrusions 11 can make contact with the contact portion 28. Therefore, the rear plate 22 is capable of moving vertically with respect to the adjusting belt 1. Meanwhile the contact portion 28 may be provided below the upper engaging piece 22*b* with the gap portion 29 therebetween.

The fixing device 4 and adjusting belt 1 are the same as the above described embodiments. The fixing device 4 has two attaching posts 42 arranged vertically, each having a sharp end, on a rear face of a rectangular cap 41. They are inserted into the attaching holes 27 in the surface plate 21 and fixed by crushing an end thereof. The adjusting belt 1 has two rows of the adjusting protrusions 11 on the surface thereof which engage the engaging protrusions 24 of the rear plate 22. The narrow foundation 12 is attached to the rear face of the adjusting belt 1.

As for use condition of this waist adjusting device, the attaching posts 42 of the fixing device 4 are pierced from the surface of the waist belt 6 and fitted to the attaching holes 27 of the surface plate 21. Thus, the surface plate 21 is fixed to the waist belt 6 by crushing a front end of the attaching post 42 by pressing. The adjusting belt 1 is attached to the waist belt 6 together with the narrow foundation 12 through both ends thereof. After the adjusting belt 1 is disposed on the surface of the surface plate 21, the rear plate 22 is inserted between the waist belt 6 and the adjusting belt 1. The engaging portions 22*c* of the rear plate 22 are engaged and fixed with the fitting portions 21*c* of the surface plate 21 so as to assemble the slider 2, so that the through portion 20 for the adjusting belt 1 is formed between the surface plate 21 and the rear plate 22.

Figure 30:
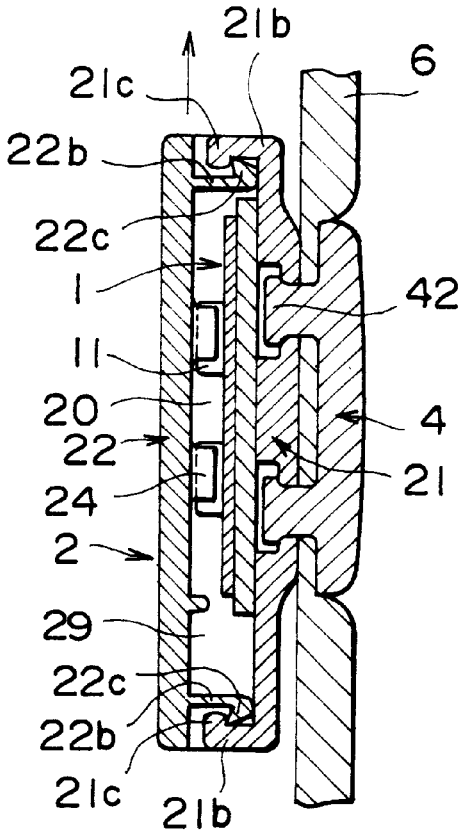
FIG. 30 is a longitudinal sectional view of the waist adjusting device of FIG. 25.
Figure 31:
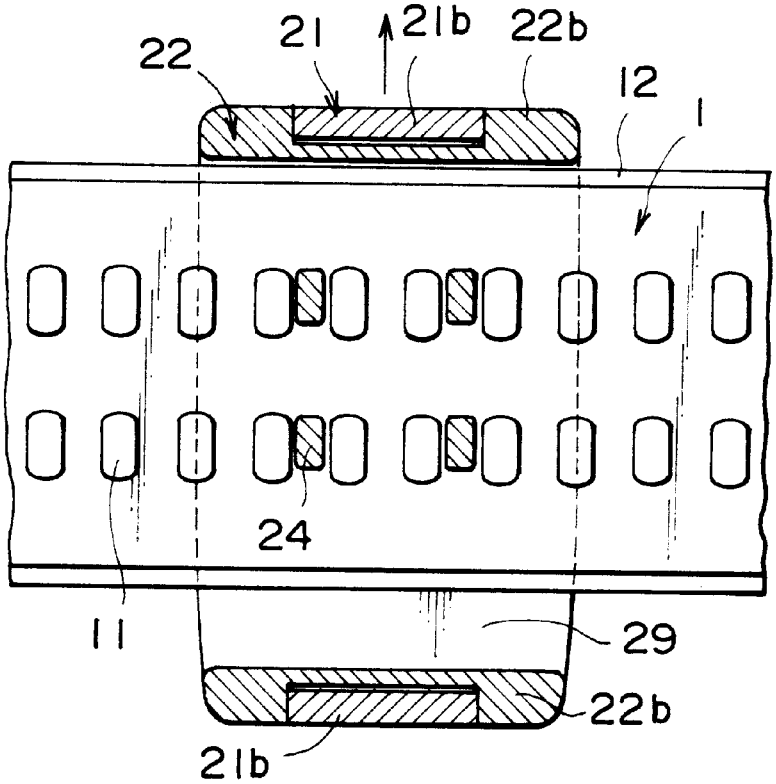
FIG. 31 is a sectional view of the waist adjusting device of FIG. 30.
Figure 32:
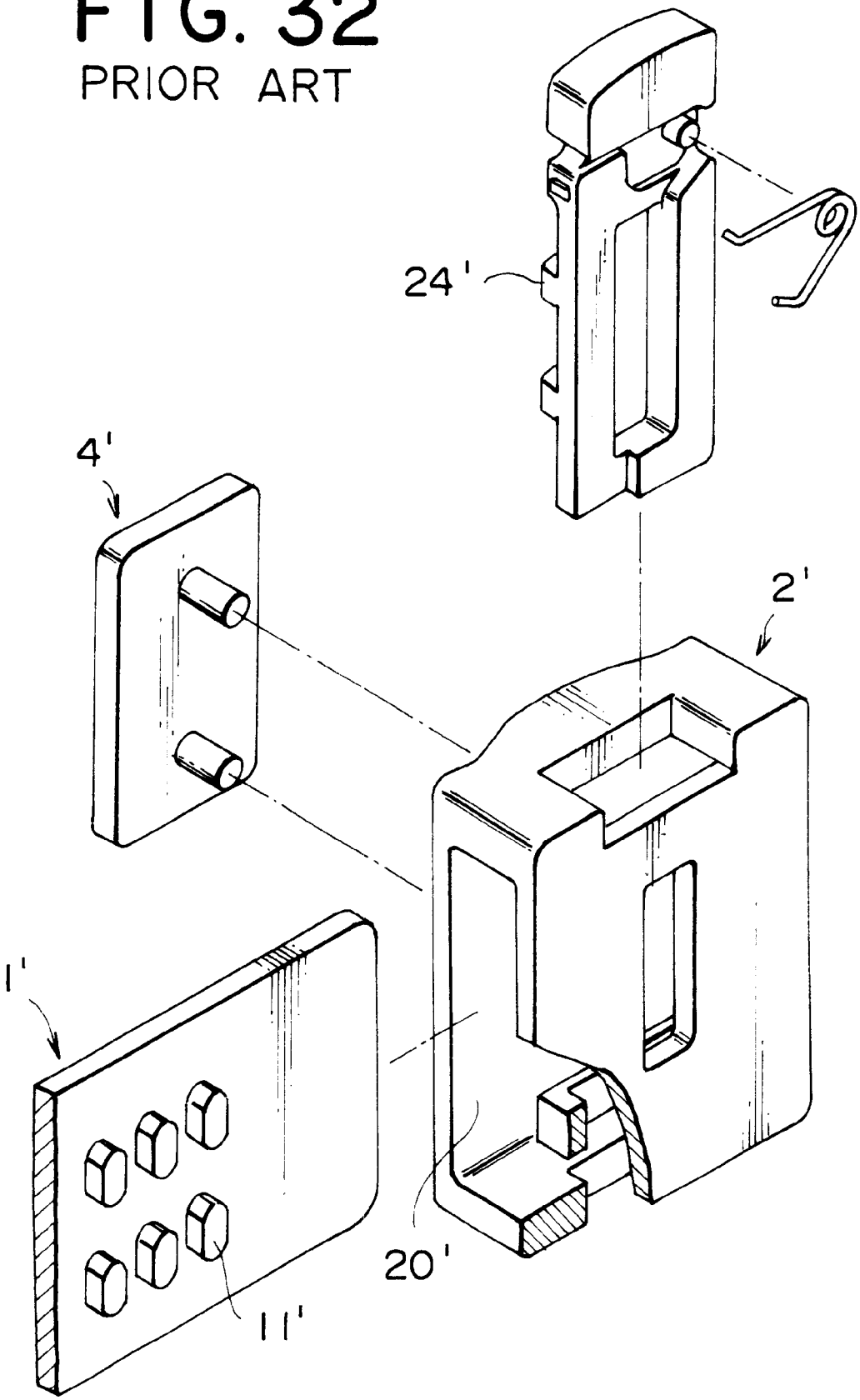
FIG. 32 PRIOR ART
FIG. 32 is an exploded perspective view of a well known waist adjusting device.

As for adjustment of the waist adjusting device, the waist belt 6 having the slider 2 is moved from the conditions shown in FIGS. 30 and 31 upward in a direction of an arrow so as to move the slider 2. Consequently, engagement between the engaging protrusions 24 and the adjusting protrusions 11 is released. Then, the slider 2 is moved to the right and left so as to adjust the length of the waist. And after that, as the waist belt 6 having the slider 2 is moved downward, the engaging protrusions 24 engage the adjusting protrusions 11 to complete the adjustment of the length of the waist.

Because the slider 2 of the waist adjusting device is divided to the surface plate 21 and the rear plate 22, the installation and assembly are carried out very easily so that an efficient mounting work is ensured. Further, there is no necessity of stocking a large amount of the waist adjusting devices meeting the sizes of various users, however various types of the waist adjusting devices can be provided corresponding to customer's demands.

Meanwhile, in this embodiment also, the vertically long through hole may be provided in the center of the rear plate 22. In such a case, an accurate installation is facilitated as described before.

As evident from the above description, the present invention may be changed or modified in various ways in its design and structure within a spirit thereof and is not restricted to the above described embodiments.

What is claimed is:

1. A waist adjusting device comprising an adjusting belt having a multiplicity of adjusting protrusions which protrude from a surface thereof, and a slider through which said adjusting belt is passed having a hollow through portion, wherein said through portion includes engaging protrusions capable of engaging the adjusting protrusions of said adjusting belt and a gap portion provided above or below the adjusting belt when the adjusting belt is passed through, and wherein the gap portion allows the adjusting protrusions of the adjusting belt and the engaging protrusions of the slider not to overlap with each other when the adjusting belt is passed through.

2. A waist adjusting device according to claim 1, wherein a protruded contact portion which the adjusting protrusion makes contact with is provided above or below the engaging protrusion within the through portion of the slider with a gap corresponding to at least the adjusting protrusion.

3. A waist adjusting device according to claim 1, wherein a restricting portion for restricting a vertical movement of the adjusting belt is provided to protrude into a gap portion provided at any one of up and down positions on a wall opposing the engaging protrusion within the through portion of the slider.

4. A waist adjusting device according to claim 1, wherein a tongue piece having an elasticity is provided at a position opposing the gap portion provided at any one of up and down positions on a wall opposing the engaging protrusion within the through portion of the slider while said tongue portion contains a protruded restricting portion for restricting a vertical movement of the adjusting belt.

5. A waist adjusting device according to claim 1, wherein the contact portion and the restricting portion are disposed within the through portion of the slider in such a relationship that the contact portion is disposed on a wall opposing the restricting portion at a slightly higher position than the restricting portion.

6. A waist adjusting device according to claim 1, wherein a surface plate and a rear plate are formed of elastic material and a gap portion allowing the surface plate and the rear plate to be opened is provided in one of a top plate and a bottom plate connecting the surface plate with the rear plate, and said through portion is formed between the surface plate and the rear plate.

7. A waist adjusting device according to claim 6, wherein the gap portion provided in the slider is formed so as to extend in an entire range of the top plate or bottom plate while the surface plate just opposes the rear plate at the position in which said gap portion exists.

8. A waist adjusting device according to claim 6, wherein a stopper insertion hole into which a stopper is inserted and fixed is provided on the top plate or the bottom plate; the stopper is formed of a plate bent in a U-shape having U-shaped leg portions elastically deformable at one end and engaging portions directed outward provided on ends of the leg portions so that said engaging portions are capable of engaging the stopper insertion hole and the other end of the stopper is formed so as to nip the surface plate.

9. A waist adjusting device according to claim 1, wherein the slider is comprised of a surface plate capable of being fixed to the waist belt and a rear plate capable of engaging with the surface plate and fitting pieces are provided on any one of the surface plate and the rear plate while engaging pieces capable of engaging the fitting pieces are provided on the other side, each of said fitting pieces and said engaging pieces provided vertically to oppose each other, and said through portion being formed between the surface plate and the rear plate.

10. A waist adjusting device according to claim 9, wherein the fitting piece has a hook-shaped fitting portion and the engaging piece has a hook-shaped engaging portion provided at a front end thereof.

11. A waist adjusting device according to claim 1, the slider further including a rear plate and an opposing surface plate, wherein a rectangular through hole is provided in a vertical direction of the center of the rear plate and at least one attaching hole having an expanded inner side provided in the surface plate opposing the through hole, and wherein a fixing device for mounting the slider onto the waist belt is a cap having protruded attaching posts, said attaching posts capable of being inserted into the attaching holes and crushed.

12. A waist adjusting device according to claim 11, wherein the adjusting belt, slider and fixing device are formed of thermoplastic resin.

* * * * *